US012071734B2

(12) United States Patent
Chen et al.

(10) Patent No.: US 12,071,734 B2
(45) Date of Patent: Aug. 27, 2024

(54) DEBRIS FLOW ANTI-COLLISION DEVICE WITH HIGH-SPEED WATER CURTAIN FOR MOUNTAIN BRIDGE

(71) Applicant: West China Normal University, Nanchong (CN)

(72) Inventors: Hongkai Chen, Zaozhuang (CN); Shengjuan Wang, Zaozhuang (CN); Quancai Wang, Zaozhuang (CN); Pengpeng Jiao, Zaozhuang (CN); Xianjin Wang, Zaozhuang (CN); Chunchao Chu, Zaozhuang (CN); Yongfa Huang, Zaozhuang (CN); Xin Wang, Zaozhuang (CN); Hui Peng, Zaozhuang (CN)

(73) Assignee: West China Normal University, Nanchong (CN)

( * ) Notice: Subject to any disclaimer, the term of this patent is extended or adjusted under 35 U.S.C. 154(b) by 134 days.

(21) Appl. No.: 17/953,696

(22) Filed: Sep. 27, 2022

(65) Prior Publication Data

US 2024/0068184 A1 Feb. 29, 2024

(30) Foreign Application Priority Data

Aug. 24, 2022 (CN) ..... 202211016270.2

(51) Int. Cl.
*E01F 7/04* (2006.01)
*E01D 18/00* (2006.01)

(52) U.S. Cl.
CPC ..... *E01F 7/04* (2013.01); *E01D 18/00* (2013.01)

(58) Field of Classification Search
CPC .. E01F 7/04; E01F 15/141; E02B 3/26; E01D 19/02; E01D 18/00
See application file for complete search history.

(56) References Cited

U.S. PATENT DOCUMENTS 1,092,731 A * 4/1914 May ..... E02B 3/26 405/214
4,548,150 A * 10/1985 Drewett ..... E02B 3/26 267/140
11,535,988 B1 * 12/2022 Han ..... E01D 11/02
(Continued)

FOREIGN PATENT DOCUMENTS

CN 110468749 A * 11/2019 ..... E01D 19/02

OTHER PUBLICATIONS

Guoh; CN 110468749-A Translation; all; 2019 (Year: 2019).*

*Primary Examiner* — Benjamin F Fiorello
(74) *Attorney, Agent, or Firm* — Westbridge IP LLC

(57) ABSTRACT

Disclosed is a debris flow anti-collision device with a high-speed water curtain for a mountain bridge. A pressurizer is fixedly installed in a groove of a base; the pressurizer is communicated with high-speed water curtain spray pipe components, and each high-speed water curtain spray pipe component penetrates through a side wall of the base and communicates with an outside; the base rotates with several groups of spoilers, an outer side of the base is fixedly provided with several groups of energy dissipation components, and a connecting bar is detachably connected between each group of energy dissipation components and the base; rear ends of the base are detachably connected with baffles; and the pressurizer is communicated with a water storage tank.

10 Claims, 3 Drawing Sheets

(56) References Cited

U.S. PATENT DOCUMENTS

| | | | | |
|---|---|---|---|---|
| 2007/0094816 | A1* | 5/2007 | Patten | E01D 19/02 14/75 |
| 2010/0287715 | A1* | 11/2010 | Voyiadjis | E02B 3/26 405/212 |
| 2011/0016644 | A1* | 1/2011 | Jo | E02B 17/0017 14/75 |
| 2023/0002991 | A1* | 1/2023 | Chen | E02D 5/22 |

* cited by examiner

DEBRIS FLOW ANTI-COLLISION DEVICE WITH HIGH-SPEED WATER CURTAIN FOR MOUNTAIN BRIDGE

TECHNICAL FIELD

The application belongs to the technical field of debris flow prevention and control, and in particular to a debris flow anti-collision device with a high-speed water curtain for a mountain bridge.

BACKGROUND

China is a high-risk area and a hardest hit area of debris flow disasters in the world. About 1.5 million kilometers of trunk roads are located in high-risk areas of debris flows (by the end of 2017). According to incomplete statistics, there are more than 10,000 debris flow gullies and more than 4,000 large and medium-sized bridges crossing the debris flow gullies in China. The debris flow is a main disaster-causing factor of a bridge damage. Setting a reinforced concrete anti-collision pier in front of a bridge pier is a main technical measure to prevent a bridge debris flow disaster. However, as the reinforced concrete anti-collision pier is a rigid structure, the reinforced concrete anti-collision pier is easy to be damaged under an impact of the debris flow. Therefore, there is an urgent need for a flexible debris flow anti-collision device with a high-speed water curtain for preventing the debris flow.

SUMMARY

An objective of the application is to provide a debris flow anti-collision device with a high-speed water curtain for a mountain bridge, so as to solve problems existing in the prior art.

To achieve the above objective, the application provides a following scheme: the application provides the debris flow anti-collision device with the high-speed water curtain for the mountain bridge, including a base; one side of the base is fixedly provided with two water-facing surfaces, and the two water-facing surfaces are arranged in a V shape; a plurality of groups of high-speed water curtain spray pipe components are fixedly arranged in the two water-facing surfaces of the base, spray directions of the high-speed water curtain spray pipe components face a debris flow, and the other ends of all the high-speed water curtain spray pipe components are connected with a pressurizer; and a groove is set above the base, and the pressurizer is fixedly installed in the groove.

A buffer plate is slidably connected to a front end of a junction of the two water-facing surfaces of the base, a plurality of groups of spoilers are rotated on the two water-facing surfaces of the base, a plurality of groups of energy dissipation components are fixedly arranged on an outer side of the base, and a connecting bar is detachably connected between each group of energy dissipation components and the top of the base; rear ends of outer walls of the base are detachably connected with baffles; and the pressurizer is communicated with a water storage tank.

In an embodiment, the base includes a front seat and a rear seat, and the front seat and the rear seat are of an integrated structure, the front seat is V-shaped, and the rear seat is rectangular; and the pressurizer is fixedly installed in the groove above the rear seat.

In an embodiment, a mud level sensor is fixedly installed above the front seat, and the mud level sensor is electrically connected with the pressurizer.

In an embodiment, the high-speed water curtain spray pipe components include a plurality of first high-speed water curtain spray pipes and a plurality of second high-speed water curtain spray pipes; the plurality of first high-speed water curtain spray pipes are installed on both side walls of the front seat, and the plurality of second high-speed water curtain spray pipes are installed on both side walls of the rear seat; and the plurality of first high-speed water curtain spray pipes and the plurality of second high-speed water curtain spray pipes are all communicated with the pressurizer.

In an embodiment, an outer end of the front seat is provided with circular grooves; one side of the buffer plate close to the circular grooves is fixedly connected with sliding rods, and the sliding rods are slidably connected with the circular grooves; and first springs are sleeved on rod bodies of the sliding rods located in the circular grooves.

In an embodiment, the spoilers include two first spoilers and two second spoilers; the two first spoilers are respectively arranged on outer side walls of both sides of the front seat, and the two second spoilers are respectively arranged on outer side walls of both sides of the rear seat; one end of each first spoiler close to the buffer plate is rotationally connected with the outer side wall of the front seat, and each spring is fixedly connected between one end of each first spoiler far away from the buffer plate and the front seat; one end of each second spoiler close to each first spoiler is rotatably connected with the outer side wall of the rear seat, and each spring is fixedly connected between one end of each second spoiler far from each first spoiler and the rear seat.

In an embodiment, the baffles include transverse plates and a vertical plates; the transverse plates and the vertical plates are vertically arranged, and the transverse plates are fixedly connected with the vertical plates; and rear parts of the rear seat are provided with installation grooves, and one end of each vertical plate far from each transverse plate is inserted into each installation groove.

In an embodiment, each group of energy dissipation components includes an energy dissipation drum, and an outer wall of the energy dissipation drum is circumferentially provided with a plurality of groups of fixed plates, and the plurality of groups of fixed plates are arranged in parallel with an axis of the energy dissipation drum; a rotating shaft is fixedly connected to a middle of each energy dissipation drum; and one end of the rotating shaft is rotationally connected with the connecting bar, and the other end of the rotating shaft is rotationally connected with a bottom plate.

In an embodiment, a bottom surface of the bottom plate is flush with a bottom surface of the base.

In an embodiment, each energy dissipation drum and each second high-speed water curtain spray pipe are arranged in a staggered manner.

The application discloses following technical effects: the anti-collision device capable of generating the high-speed water curtain in time is arranged at an impact direction of a bridge pier facing the debris flow, so as to regulate a flow direction of the debris flow, avoid a direct impact damage of the debris flow on the bridge pier and ensure a structural safety of the bridge pier; according to the application, a front part of the front seat is provided with the buffer plate, so that the direct impact of the debris flow on the base is greatly reduced; moreover, the arc-shaped buffer plate guides the debris flow to positions of the spoilers, the high-speed water curtain spray pipes and the energy dissipation components on both sides; further, the flow direction of the debris flow is changed, and the impact of the debris flow is dissipated, thereby reducing the damage to a bridge structure.

BRIEF DESCRIPTION OF THE DRAWINGS

In order to more clearly explain embodiments of the application or technical solutions in the prior art, the following briefly introduces drawings that a need to be used in the embodiments. Obviously, the drawings in the following description are only some embodiments of the application. For those of ordinary skill in the art, other drawings may be obtained according to these drawings without any creative labor.

DETAILED DESCRIPTION OF THE EMBODIMENTS

Technical solutions in embodiments of the application are clearly and completely described below with reference to drawings in the embodiments of the application. Obviously, the described embodiments are only a part of the embodiments of the application, but not all of them. Based on the embodiments of the application, all other embodiments obtained by ordinary technicians in the field without creative labor are within a scope of the application.

In order to make the above objects, features and advantages of the application more obvious and understandable, the application is explained in further detail below with reference to the drawings and detailed description.

Figure 1:
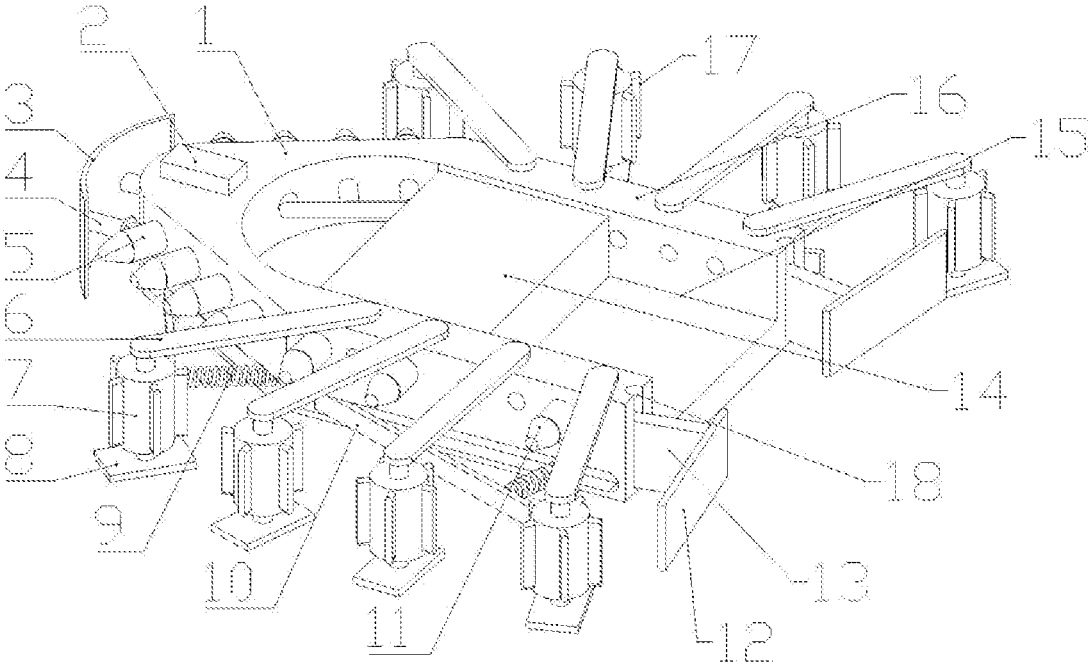
FIG. 1 is an isometric view of an anti-collision device according to the application.
Figure 2:
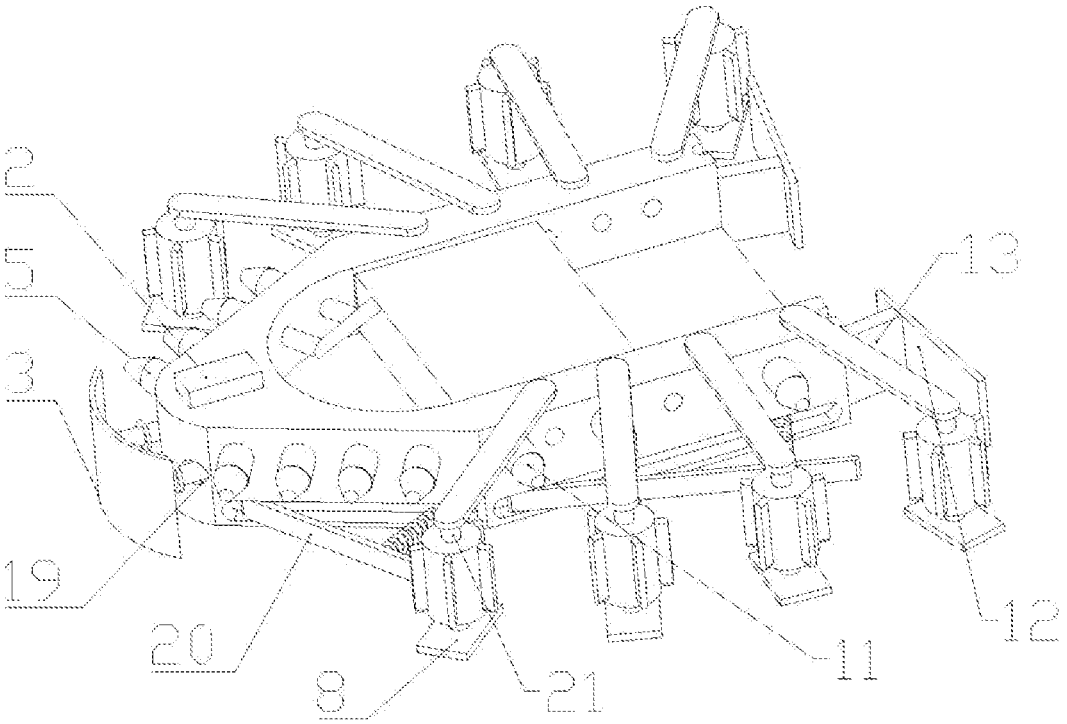
FIG. 2 is a structural schematic diagram of an anti-collision device according to the application from another perspective.
Figure 3:
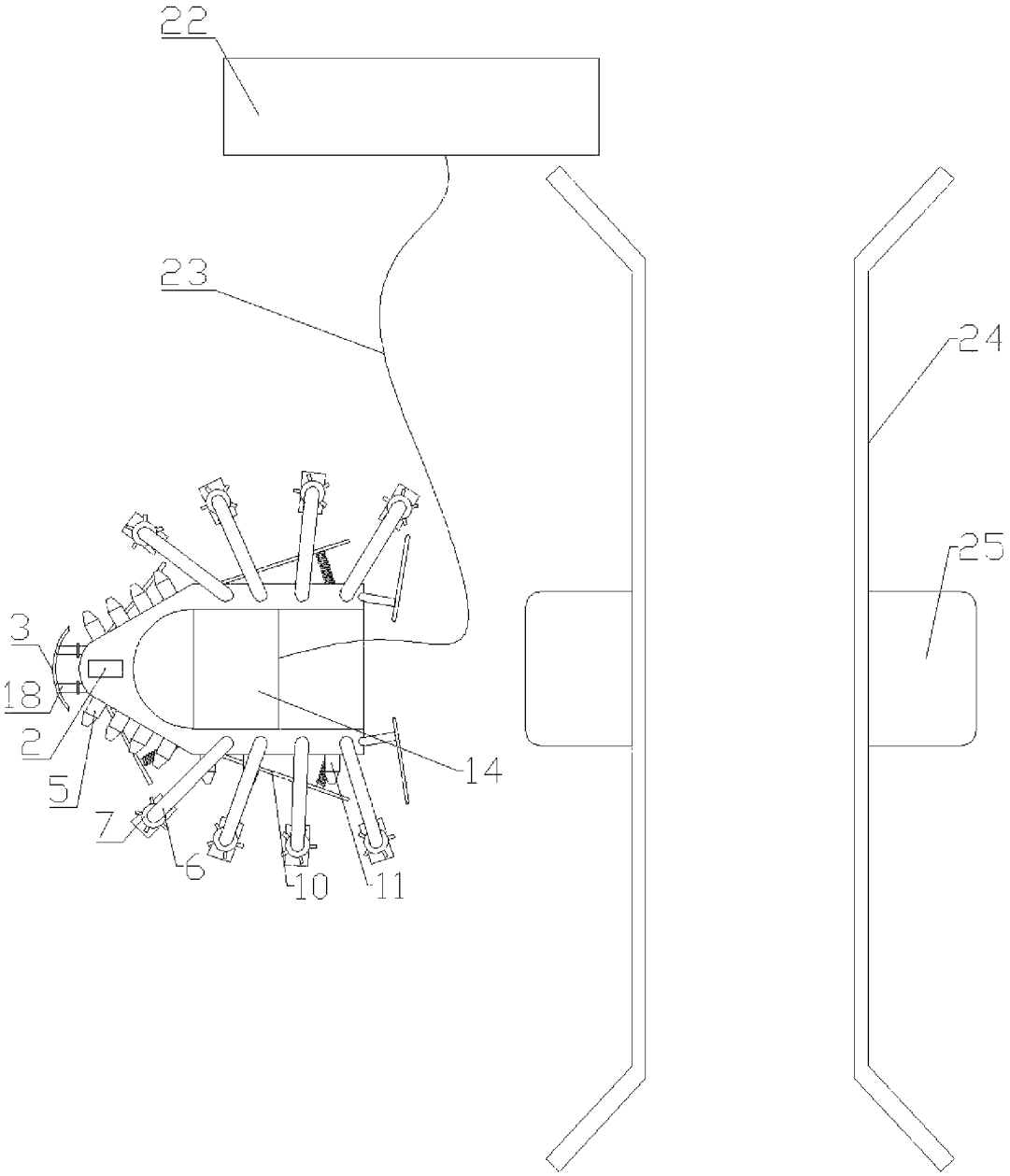
FIG. 3 is a schematic diagram of an installation position of an anti-collision device according to the application.

With Reference to FIGS. 1-3, the application provides a debris flow anti-collision device with a high-speed water curtain for a mountain bridge, including a base; the base is provided with a groove 15, and a pressurizer 14 is fixedly installed in the groove 15; the pressurizer 14 is communicated with high-speed water curtain spray pipe components, and one end of each high-speed water curtain spray pipe component far from the pressurizer 14 penetrates through a side wall of the base and communicates with an outside; a front end of an outer wall of the base is slidably connected with a buffer plate 3, an outer side wall of the base rotates with several groups of spoilers, an outer side of the base is fixedly provided with several groups of energy dissipation components, and one connecting bar 6 is detachably connected between each group of energy dissipation components and a top of the base; rear ends of outer walls of the base are detachably connected with baffles; and the pressurizer 14 is communicated with a water storage tank 22. In the application, an anti-collision device which generates a high-speed water curtain in time is arranged in an impact direction of a pier 25 of a bridge 24 and is used for regulating a flow direction of a debris flow, avoiding a direct impact damage of the debris flow on the pier 25 of the bridge 24, and ensuring a structural safety of the pier 25 of the bridge 24. According to the application, a front part of a front seat 1 is provided with the buffer plate 3, so a direct impact of the debris flow on the base is greatly reduced. Moreover, the arc-shaped buffer plate 3 guides the debris flow to positions of the spoilers, high-speed water curtain spray pipes 23 and the energy dissipation components on both sides, further changes the flow direction of the debris flow, dissipates the impact of the debris flow, and further reduces the damage to the structure of the bridge 24.

The base includes the front seat 1 and a rear seat 16; the front seat 1 and the rear seat 16 are in an integrated structure, the front seat 1 is V-shaped, and the rear seat 16 is rectangular; and the pressurizer 14 is fixedly installed in the groove 15 above the rear seat 16. The groove 15 is set above the front seat 1 and the rear seat 16, but the pressurizer 14 is only arranged above the rear seat 16, and an upper part of the groove 15 may be provided with a cover plate as required to prevent the pressurizer 14 from being damaged.

A mud level sensor 2 is fixedly installed above the front seat 1, and the mud level sensor 2 is electrically connected with the pressurizer 14. The mud level sensor 2 detects a height of the debris flow in real time, and timely transmits height information to a control system (the control system is in the prior art); the control system controls the pressurizer 14 to start, so that first high-speed water curtain spray pipes 5 and second high-speed water curtain spray pipes 11 spray water flows.

The high-speed water curtain spray pipe components include a plurality of first high-speed water curtain spray pipes 5 and a plurality of second high-speed water curtain spray pipes 11; the plurality of first high-speed water curtain spray pipes 5 are installed on both side walls of the front seat 1, and the plurality of second high-speed water curtain spray pipes 11 are installed on both side walls of the rear seat 16; and the plurality of first high-speed water curtain spray pipes 5 and the plurality of second high-speed water curtain spray pipes 11 are all communicated with the pressurizer 14. The first high-speed water curtain spray pipes 5 and the second high-speed water curtain spray pipes 11 may change the impact direction according to an actual situation.

An outer end of the front seat 1 is provided with circular grooves 19; one side of the buffer plate 3 close to the circular grooves 19 is fixedly connected with sliding rods 4, and the sliding rods 4 are slidably connected with the circular grooves 19; first springs 9 are sleeved on rod bodies of the sliding rods 4 located in the circular grooves 19; the buffer plate 3 is arc-shaped, and the arc-shaped buffer plate 3 may not only bear the impact of the debris flow, but also guide the debris flow to both sides of the base.

The spoilers include two first spoilers 20 and two second spoilers 10; the two first spoilers 20 are respectively arranged on the outer side walls of both sides of the front seat 1, and the two second spoilers 10 are respectively arranged on the outer side walls of both sides of the rear seat 16; one end of each first spoiler 20 close to the buffer plate 3 is rotationally connected with the outer side wall of the front seat 1, and each spring 9 is fixedly connected between one end of each first spoiler 20 far away from the buffer plate 3 and the front seat 1; one end of each second spoiler 10 close to each first spoiler 20 is rotatably connected with the outer side wall of the rear seat 16, and each spring 9 is fixedly connected between one end of each second spoiler 10 far from each first spoiler 20 and the rear seat 16. The spoilers may protect a bottom of the base and protect the structural safety of the base.

The baffles include transverse plates 12 and a vertical plates 13; the transverse plates 12 and the vertical plates 13 are vertically arranged, and the transverse plates 12 are fixedly connected with the vertical plates 13; rear parts of the rear seat 16 are provided with installation grooves 18, and one end of each vertical plate 13 far from each transverse plate 12 is inserted into each installation groove 18; and the baffles may intercept a part of the debris flow that has not been successfully diverted, and prevent this part of the debris flow from impacting the pier 25 of the bridge 24.

Each group of energy dissipation components includes an energy dissipation drum 7, and an outer wall of the energy dissipation drum 7 is circumferentially provided with a plurality of groups of fixed plates 17, and the plurality of groups of fixed plates 17 are arranged in parallel with an axis of the energy dissipation drum 7; a rotating shaft 21 is fixedly connected to a middle of each energy dissipation drum 7, one end of the rotating shaft 21 is rotationally connected with the connecting bar 6, and the other end of the rotating shaft 21 is rotationally connected with a bottom plate 8. The bottom plate 8 is flush with a bottom surface of the base. Each energy dissipation drum 7 is staggered with each second high-speed water curtain spray pipe 11. The energy dissipation components do not affect water flows sprayed by the second high-speed water curtain spray pipes 11.

Working process: the base of the device is fixedly installed; when installing the base, the buffer plate 3, the spoilers and the energy dissipation drums 7 on the base must be located above the ground, so that they may work normally; secondly, each bottom plate 8 of each energy dissipation drum 7 is fixed with the ground through the anchor; the device is specifically installed at the front of the pier 25 of the bridge 24, and the buffer plate 3 needs to face the flow direction of the debris flow; then, the water storage tank 22 is installed on the ground above an edge of the debris flow ditch, and the water storage tank 22 is communicated with the pressurizer 14 through the water pipes 23; and the water pipes 23 should be buried under the ground of the debris flow ditch to prevent the debris flow from washing the water pipes 23.

When the debris flow occurs, the debris flow flows directly against the anti-collision device, and the debris flow first impacts the buffer plate 3. When an impact force of the debris flow is large enough, the buffer plate 3 is squeezed and simultaneously moves to the front seat 1. At this time, the first high-speed water curtain spray pipes 5 and the second high-speed water curtain spray pipes 11 on both sides of the buffer plate 3 spray high-speed water flows to impact the debris flow and make the debris flow change lanes. At the positions close to the ground, the first spoilers 20 and the second spoilers 10 block the debris flow close to the ground to reduce the impact of the debris flow on the base. Moreover, the energy dissipation drums 7 may dissipate an energy of the high-speed debris flow, and may also block large pieces of gravel, thus protecting the structural safety of the base and the pier 25 of the bridge 24.

In a description of the application, it should be understood that an orientation or a positional relationship indicated by terms "vertical", "horizontal", "up", "down", "front", "rear", "left", "right", "vertical", "horizontal", "top", "bottom", "inner", "outer" and so on is based on the orientation or positional relationship shown in the drawings, only for the convenience of describing the application, rather than indicating or implying that the device or element must have a specific orientation, be configured and operate in a specific orientation, and therefore should not be understood as limiting the application.

The above-mentioned embodiments only describe a preferred mode of the application, but do not limit the scope of the application. On a premise of not departing from a design spirit of the application, all kinds of modifications and improvements made by ordinary technicians in the field to the technical scheme of the application shall fall within the scope of protection determined by claims of the application.

What is claimed is:

1. A debris flow anti-collision device with a high-speed water curtain for a mountain bridge, comprising a base, wherein one side of the base is fixedly provided with two water-facing surfaces, and the two water-facing surfaces are arranged in a V shape; a plurality of groups of high-speed water curtain spray pipe components are fixedly arranged in the two water-facing surfaces of the base, spray directions of the high-speed water curtain spray pipe components face a debris flow, and the other ends of all the high-speed water curtain spray pipe components are connected with a pressurizer; a groove is set above the base, and the pressurizer is fixedly installed in the groove; and a buffer plate is slidably connected to a front end of a junction of the two water-facing surfaces of the base, a plurality of groups of spoilers are rotated on the two water-facing surfaces of the base, a plurality of groups of energy dissipation components are fixedly arranged on an outer side of the base, and a connecting bar is detachably connected between each group of energy dissipation components and the top of the base; rear ends of outer walls of the base are detachably connected with baffles; and the pressurizer is communicated with a water storage tank.

2. The debris flow anti-collision device with the high-speed water curtain for the mountain bridge according to claim 1, wherein the base comprises a front seat and a rear seat, and the front seat and the rear seat are of an integrated structure, the front seat is V-shaped, and the rear seat is rectangular; and the pressurizer is fixedly installed in the groove above the rear seat.

3. The debris flow anti-collision device with the high-speed water curtain for the mountain bridge according to claim 2, wherein a mud level sensor is fixedly installed above the front seat, and the mud level sensor is electrically connected with the pressurizer.

4. The debris flow anti-collision device with the high-speed water curtain for the mountain bridge according to claim 2, wherein the high-speed water curtain spray pipe components comprise a plurality of first high-speed water curtain spray pipes and a plurality of second high-speed water curtain spray pipes; the plurality of first high-speed water curtain spray pipes are installed on both side walls of the front seat, and the plurality of second high-speed water curtain spray pipes are installed on both side walls of the rear seat; and the plurality of first high-speed water curtain spray pipes and the plurality of second high-speed water curtain spray pipes are all communicated with the pressurizer.

5. The debris flow anti-collision device with the high-speed water curtain for the mountain bridge according to claim 4, wherein each group of energy dissipation components comprises an energy dissipation drum, and an outer wall of the energy dissipation drum is circumferentially provided with a plurality of groups of fixed plates, and the plurality of groups of fixed plates are arranged in parallel with an axis of the energy dissipation drum; a rotating shaft is fixedly connected to a middle of each energy dissipation drum; and one end of the rotating shaft is rotationally connected with the connecting bar, and the other end of the rotating shaft is rotationally connected with a bottom plate.

6. The debris flow anti-collision device with the high-speed water curtain for the mountain bridge according to claim 5, wherein a bottom surface of the bottom plate is flush with a bottom surface of the base.

7. The debris flow anti-collision device with the high-speed water curtain for the mountain bridge according to claim 5, wherein each energy dissipation drum and each second high-speed water curtain spray pipe are arranged in a staggered manner.

8. The debris flow anti-collision device with the high-speed water curtain for the mountain bridge according to claim 2, wherein an outer end of the front seat is provided with circular grooves; one side of the buffer plate close to the circular grooves is fixedly connected with sliding rods, and the sliding rods are slidably connected with the circular grooves; and first springs are sleeved on rod bodies of the sliding rods located in the circular grooves.

9. The debris flow anti-collision device with the high-speed water curtain for the mountain bridge according to claim 2, wherein the spoilers comprise two first spoilers and two second spoilers; the two first spoilers are respectively arranged on outer side walls of both sides of the front seat, and the two second spoilers are respectively arranged on outer side walls of both sides of the rear seat; one end of each first spoiler close to the buffer plate is rotationally connected with the outer side wall of the front seat, and each spring is fixedly connected between one end of each first spoiler far away from the buffer plate and the front seat; one end of each second spoiler close to each first spoiler is rotatably connected with the outer side wall of the rear seat, and each spring is fixedly connected between one end of each second spoiler far from each first spoiler and the rear seat.

10. The debris flow anti-collision device with the high-speed water curtain for the mountain bridge according to claim 2, wherein the baffles comprise transverse plates and a vertical plates; the transverse plates and the vertical plates are vertically arranged, and the transverse plates are fixedly connected with the vertical plates; and rear parts of the rear seat are provided with installation grooves, and one end of each vertical plate far from each transverse plate is inserted into each installation groove.

* * * * *